US006559369B1

(12) United States Patent
Gilmore

(10) Patent No.: US 6,559,369 B1
(45) Date of Patent: May 6, 2003

(54) APPARATUS AND METHOD FOR SELF-TUNING A PIANO

(76) Inventor: Donald A. Gilmore, 930 Broadway, #101, Kansas City, MO (US) 64105

( * ) Notice: Subject to any disclaimer, the term of this patent is extended or adjusted under 35 U.S.C. 154(b) by 0 days.

(21) Appl. No.: 10/046,636

(22) Filed: Jan. 14, 2002

(51) Int. Cl.[7] ..... G10G 7/02
(52) U.S. Cl. ..... 84/455; 84/200
(58) Field of Search ..... 84/454, 455, 458, 84/200, 312 R

(56) References Cited

U.S. PATENT DOCUMENTS

| | | | |
|---|---|---|---|
| 2,207,450 | A | 7/1940 | Bergan et al. |
| 3,530,756 | A | 9/1970 | Chapman |
| 3,588,311 | A | 6/1971 | Zoller |
| 3,675,529 | A | 7/1972 | Van Der Woerd |
| 4,041,783 | A | 8/1977 | Shimauchi et al. |
| 4,044,239 | A | 8/1977 | Shimauchi et al. |
| 4,075,921 | A | 2/1978 | Heet |
| 4,077,298 | A | 3/1978 | Kondo |
| 4,184,398 | A | 1/1980 | Siegelman |
| 4,196,652 | A | 4/1980 | Raskin |
| 4,271,746 | A | 6/1981 | Dobbie |
| 4,319,515 | A | 3/1982 | Mackworth-Young |
| 4,375,180 | A | 3/1983 | Scholz |
| 4,484,506 | A | 11/1984 | Sato |
| 4,941,388 | A | 7/1990 | Hoover et al. |
| 5,010,575 | A | 4/1991 | Marutake et al. |
| 5,065,660 | A | 11/1991 | de Buda |
| 5,285,711 | A | 2/1994 | Sanderson |
| 5,523,526 | A | 6/1996 | Shattil |
| 5,585,588 | A | 12/1996 | Tumura |
| 5,719,343 | A | 2/1998 | Reyburn |
| 5,736,661 | A | 4/1998 | Armstrong |
| 5,756,913 | A | 5/1998 | Gilmore |
| 5,780,759 | A | 7/1998 | Szalay |
| 5,929,360 | A | 7/1999 | Szalay |
| 5,932,827 | A | 8/1999 | Osborne et al. |
| 5,936,179 | A | 8/1999 | Merrick et al. |
| 5,949,014 | A | 9/1999 | Rashak et al. |
| 6,479,738 | B1 | 11/2002 | Gilmore |

OTHER PUBLICATIONS

Interconnect Devices, Inc, Interconnect Devices, Inc. Catalog, Nov. 2000, p. 38, 6th Edition, Kansas City, Kansas, United States of America.

*Primary Examiner*—Jeffrey Donels
(74) *Attorney, Agent, or Firm*—Blackwell Sanders Peper Martin LLP

(57) ABSTRACT

An apparatus and method for self-tuning a piano that includes selectively applying voltage with a voltage mechanism to each piano string of a plurality of piano strings to provide either thermal expansion upon an application of voltage or thermal contraction with an absence of voltage to alter pitch of the piano string to a predetermined value, wherein each piano string of the plurality of piano strings has a first end portion and a second end portion, wherein the first end portion of each piano string of the plurality of piano strings is respectively secured to a housing by a plurality of first attachment mechanisms and the second end portion of each piano string of the plurality of piano strings is respectively secured to a housing by a plurality of second attachment mechanisms and the plurality of piano strings are electrically insulated from each other.

29 Claims, 6 Drawing Sheets

APPARATUS AND METHOD FOR SELF-TUNING A PIANO

FIELD OF THE INVENTION

This invention relates to an apparatus for tuning a piano, and more particularly, to an electrical device that automatically tunes a piano.

BACKGROUND OF THE INVENTION

Traditionally, an acoustic piano is tuned by a trained technician, schooled in the craft of piano tuning, who utilizes complex, learned methods. The trained technician determines when the piano string is in tune by either using a tuning fork or an electronic strobe tuner as a pitch sensing aid and then systematically tuning each piano string by manually turning the tuning pins with a special wrench. This service is usually required at least twice a year and the pianist is virtually the only modern musician that cannot tune his or her own instrument.

U.S. Pat. No. 4,044,239, issued to Shimauchi et al. on Aug. 23, 1977, discloses an automatic adjustment device for piano strings that requires use of a separate pulse motor art connected to the tuning pin for each and every piano string. This is a very expensive apparatus that could affect the acoustics of the piano by requiring the presence of 220 pulse motors and associated electronic controllers due to the fact that an average piano has 220 piano strings. The maintenance expenses and potential problems associated with this type of apparatus will be considerable and the failure of just one mechanism associated with a single string could negate the benefits of this type of device.

The present invention is directed to overcoming one or more of the problems set forth above.

SUMMARY OF INVENTION

In one aspect of this invention, an apparatus for self-tuning a piano is disclosed. This apparatus includes a housing, a plurality of piano strings, each having a first end portion and a second end portion, a plurality of first attachment mechanisms for respectively securing the first end portion of each piano string of the plurality of piano strings to the housing, a plurality of second attachment mechanisms for respectively securing the second end portion of each piano string of the plurality of piano strings to the housing and a voltage mechanism electrically connected to each piano string of the plurality of piano strings for selectively applying voltage to thermally expand each piano string of the plurality of piano strings to alter pitch to a predetermined value.

In another aspect of this invention, an apparatus for self-tuning a piano is disclosed. This apparatus includes a housing, a plurality of piano strings, each having a first end portion and a second end portion, a plurality of first attachment mechanisms for securing the first end portion of each piano string of the plurality of piano strings to the housing, a plurality of second attachment mechanisms for securing the second end portion of each piano string of the plurality of piano strings to the housing, a voltage mechanism that is electrically connected to each piano string of the plurality of piano strings, a plurality of pickups positioned adjacent to the plurality of piano strings that generates a signal that is representative of pitch for each piano string of the plurality of piano strings and a pitch comparison mechanism that contrasts the representative value for pitch for each piano string of the plurality of piano strings with a predetermined value of pitch for each piano string of the plurality of piano strings and generates a differential value, wherein the pitch comparison mechanism is electrically connected to the voltage mechanism so that voltage from the voltage mechanism can be applied to each piano string of the plurality of piano strings so that the respective differential value can be minimized due to thermal expansion of each piano string caused by an application of voltage.

Yet another aspect of the present invention, an apparatus for self-tuning a piano is disclosed. The method includes a housing, a plurality of piano strings, each having a first end portion and a second end portion, a plurality of tuning pins for securing the first end portion of each piano string of the plurality of piano strings to the housing, a plurality of hitch pins for securing the second end portion of each piano string of the plurality of piano strings to the housing, a voltage source connected to a selective switching mechanism, which is electrically connected to each piano string of the plurality of piano strings, a plurality of magnetic pickups positioned adjacent to the plurality piano strings that generates a signal that is representative of pitch for each piano string of the plurality of piano strings, a plurality of drive coils positioned adjacent to the plurality piano strings that sustains vibration in each piano string of the plurality of piano strings and a controller that contrasts the representative value for pitch for each piano string of the plurality of piano strings with a predetermined value of pitch for each piano string of the plurality of piano strings and generates a differential value, wherein the controller is electrically connected to the switching mechanism so that pulse width modulated voltage from the voltage source can be applied to each piano string of the plurality of piano strings so that the respective differential value can be minimized due to thermal expansion of each piano string by an application of voltage and thermal contraction in an absence of voltage.

Still another aspect of the present invention, a method for self-tuning a piano is disclosed. The method includes selectively applying voltage with a voltage mechanism to each piano string of a plurality of piano strings to provide thermal expansion of each piano string by an application of voltage and thermal contraction of each piano string in an absence of voltage to alter pitch of the piano string to a predetermined value, wherein each piano string of the plurality of piano strings has a first end portion and a second end portion, wherein the first end portion of each piano string of the plurality of piano strings is respectively secured to a housing by a plurality of first attachment mechanisms and the second end portion of each piano string of the plurality of piano strings is respectively secured to the housing by a plurality of second attachment mechanisms and the plurality of piano strings are electrically insulated from each other.

Another aspect of the present invention, a method for self-tuning a piano is disclosed. The method includes selectively applying voltage with a voltage mechanism to each piano string of a plurality of piano strings to provide thermal expansion of each piano string by an application of voltage and thermal contraction of each piano string in an absence of voltage to alter pitch of the piano string to a predetermined value, wherein each piano string of the plurality of piano strings has a first end portion and a second end portion, wherein the first end portion of each piano string of the plurality of piano strings is respectively secured to a housing by a plurality of first attachment mechanisms and the second end portion of each piano string of the plurality of piano strings is respectively secured to a housing by a plurality of second attachment mechanisms and the plurality of piano strings are electrically insulated from each other, generating a signal that is representative of pitch for each piano string of the plurality of piano strings with a plurality of pickups positioned adjacent to the plurality of piano strings, comparing the representative value for pitch for each piano string of the plurality of piano strings with a predetermined value of pitch for each piano string of the plurality of piano strings with a pitch comparison mechanism to generate a differential value and selectively applying voltage from the voltage mechanism to each piano string of the plurality of piano strings so that the respective differential value can be minimized due to thermal expansion of each piano string by an application of voltage and thermal contraction of each piano string in an absence of voltage.

These are merely a few illustrative aspects of the present invention and should not be deemed an all-inclusive listing of the innumerable aspects associated with the present invention.

BRIEF DESCRIPTION OF DRAWINGS

For a better understanding of the present invention, reference may be made to the accompanying drawings in which.

DETAILED DESCRIPTION OF THE INVENTION

Figure 1:
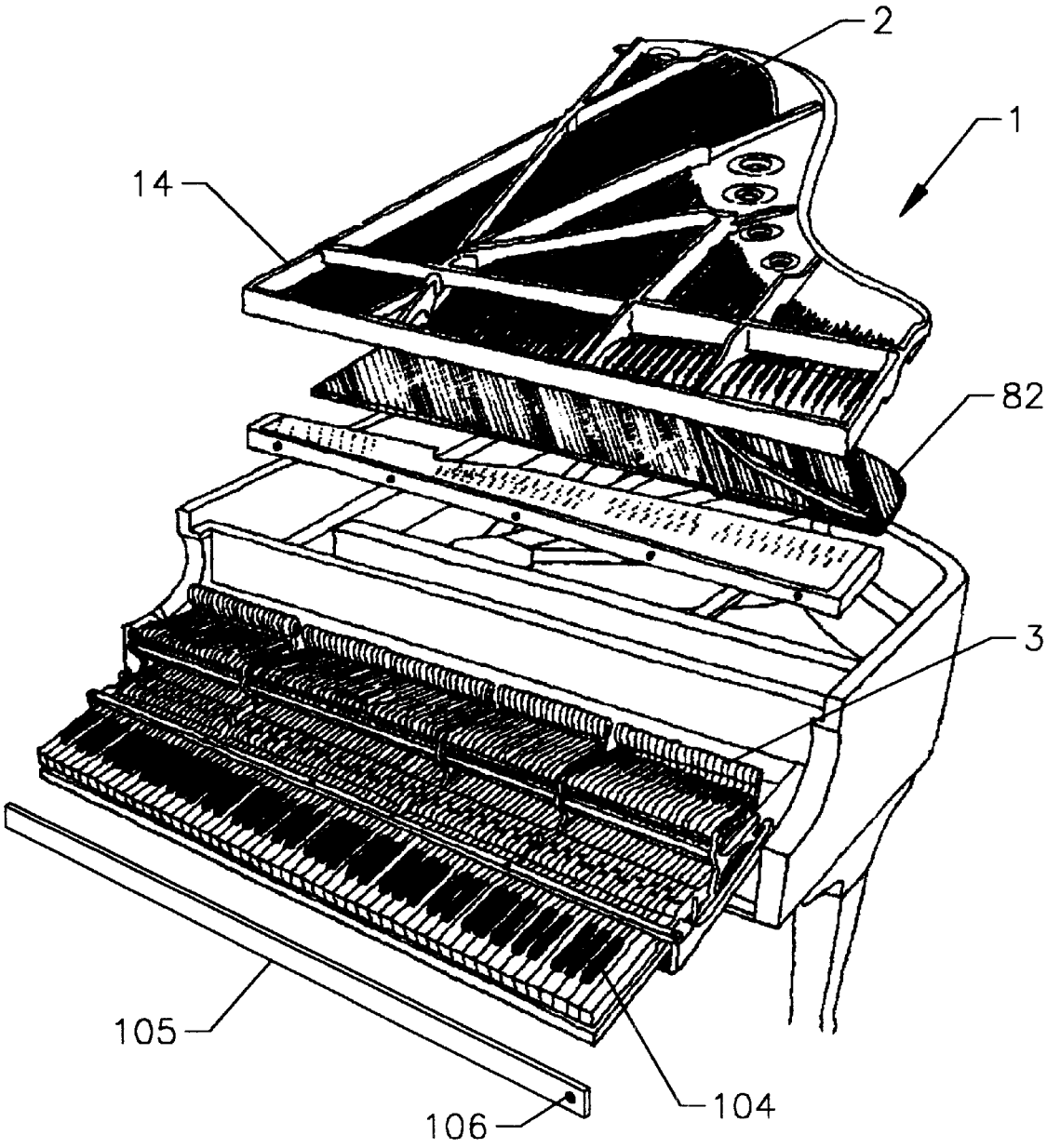
FIG. 1 is a perspective view of an illustrative grand piano having a tune button associated with the self-tuning apparatus of the present invention.

Referring now to FIG. 1, a piano is generally indicated by numeral 1 and utilizes piano strings 2 secured within a housing 14. Piano strings 2 must be made of an electrically conductive substance that will thermally expand upon an application of a voltage. Piano strings 2 are preferably made of metal and are optimally made of steel. The musical sounds produced by a piano 1 are the result of compressional waves of air created by the mechanical vibration of the piano string 2 after being struck by a hammer 3. The hammer 3 simultaneously strikes one to three piano strings 2 that have been tuned in unison with most notes created from three piano strings 2 and the lower notes utilizing one or two piano strings 2.

Figure 2:
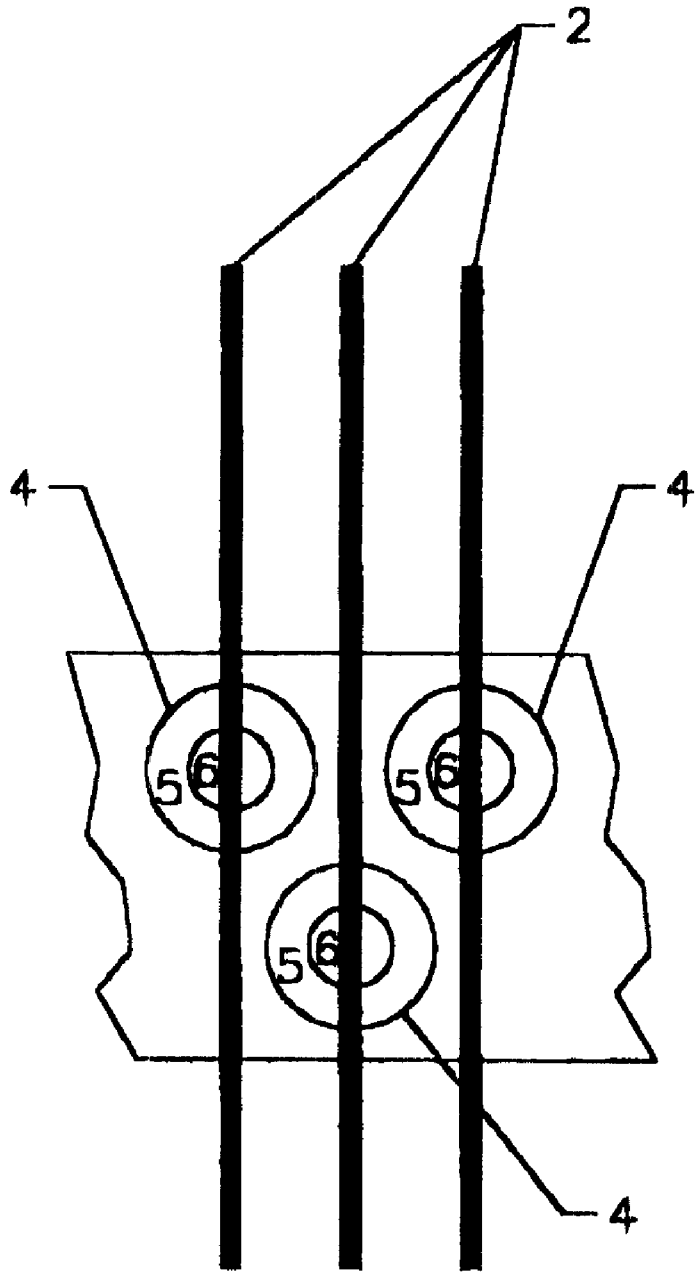
FIG. 2 is a top schematic view of piano strings with associated magnetic pickups mounted in a pickup housing for sensing vibration in the piano strings.

This vibration of the piano string 2, as shown in FIG. 2, is preferably sensed by a magnetic pickup 4 for a ferrous piano string 2, which includes a coil of wire 5 wrapped around a magnetic core 6. When this magnetic pickup 4 is brought near a vibrating piano string 2, an electrical current is induced in the windings of the coil of wire 5 that mimics the motion of the piano string 2. Since this magnetic pickup 4 is only sensitive to physical movement of the piano string 2, ordinary acoustic sound will not be picked up and each individual piano string 2, having at least one dedicated magnetic pickup 4, may be tuned individually even though a number of piano strings 2 may be vibrating together. A piano 1, having a self-tuning apparatus of the present invention, would include an array of magnetic pickups 4 that are typically located either under or over each piano string 2, as shown in FIG. 2.

Figure 3:
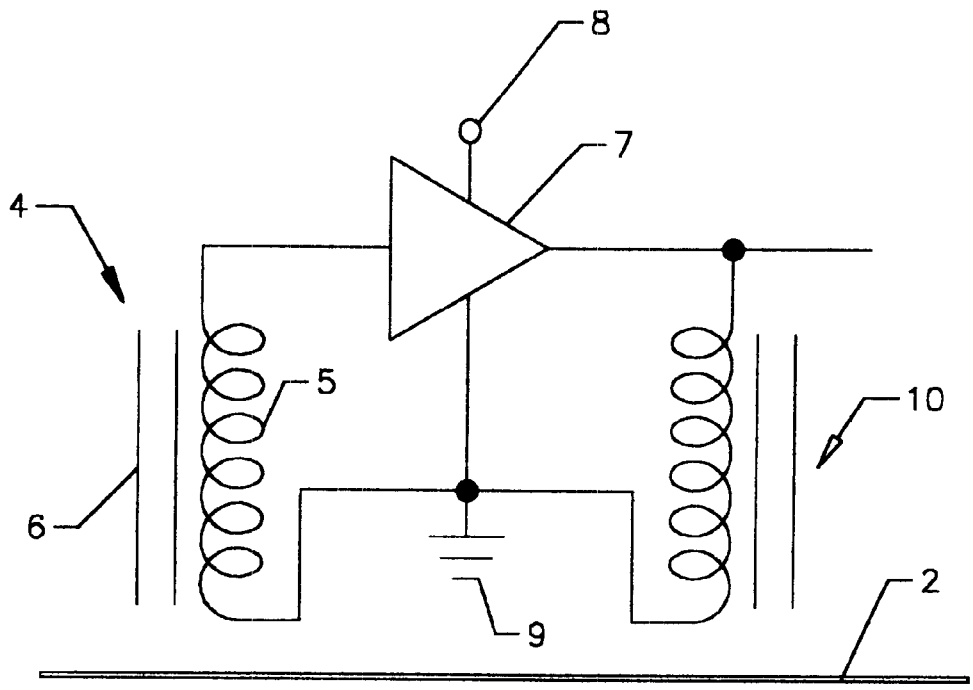
FIG. 3 is an electrical schematic of the circuit associated with each magnetic pickup, shown in FIG. 2, utilizing a separate pickup coil and drive coil.

Referring now to FIG. 3, an electrical circuit is illustrated that takes the signal from the coil of wire 5 and amplifies this signal with an amplifier 7, e.g., operational amplifier, which is connected to both a voltage source 8 and to ground 9. This amplified signal is then fed into a drive coil 10 located near the magnetic pickup 4 and along the same piano string 2. This drive coil 10 will drive the piano string 2 and cause it to continue to vibrate. Thus, when a note played on a piano 1, configured in this manner, the note can be sustained indefinitely rather than decaying quickly.

Figure 4:
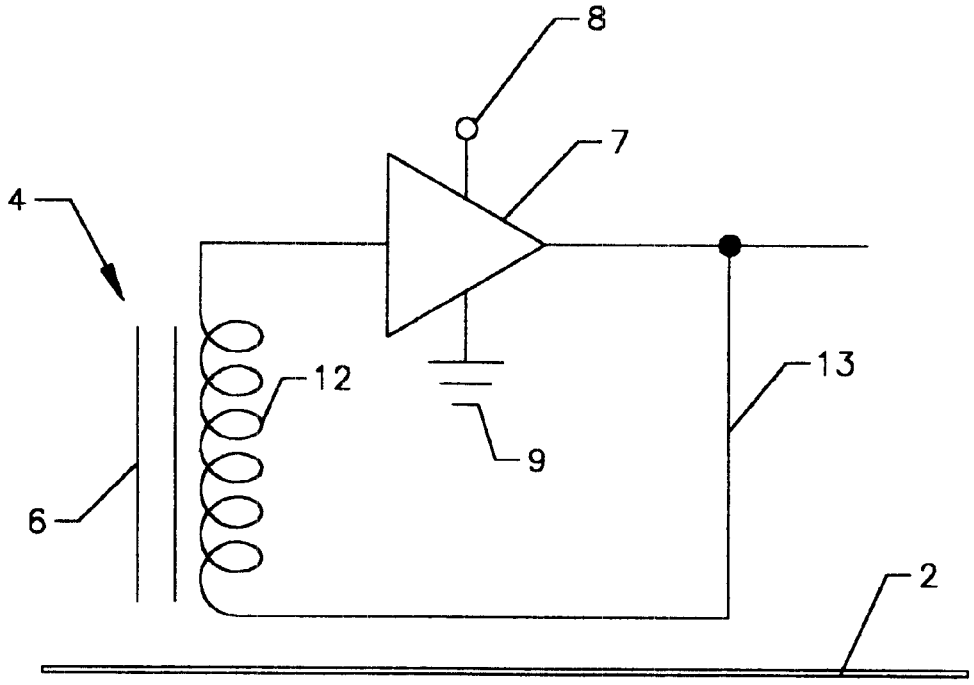
FIG. 4 is an electrical block diagram of the circuit associated with each magnetic pickup, shown in FIG. 2, utilizing a combination pickup coil and drive coil.

Referring now to FIG. 4, this same effect can be accomplish using a combination pickup and drive coil 12 that functions as both a drive coil 10 and the coil of wire 5 for a magnetic pickup 4. The amplified signal is fed back into the combination pickup and drive coil 12 through a feedback loop 13.

Figure 5:
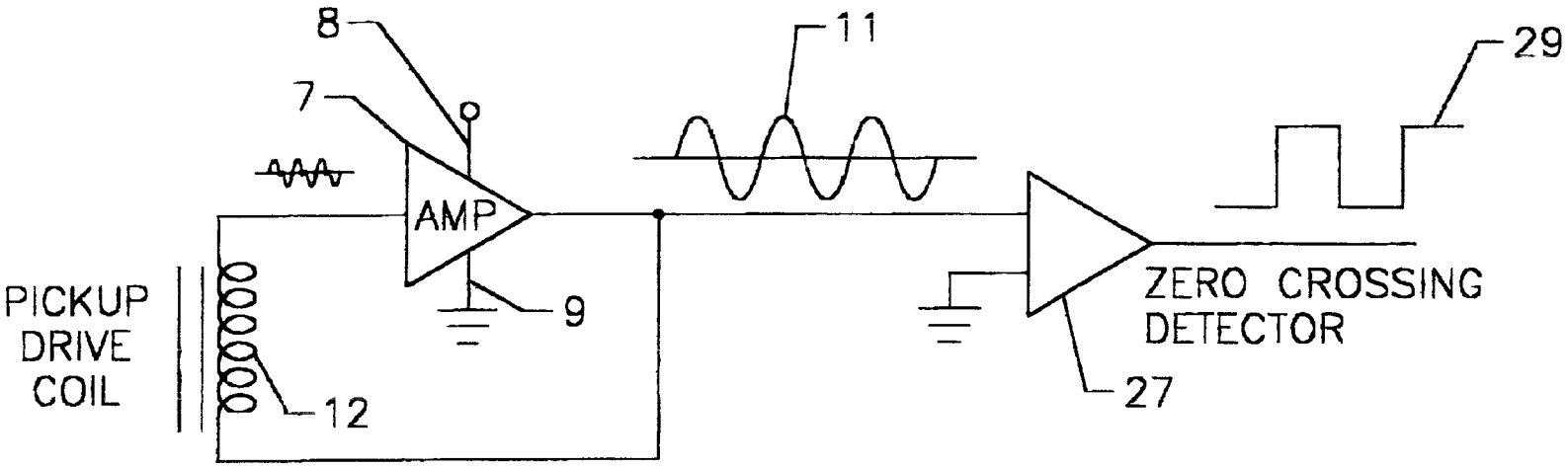
FIG. 5 is an electrical block diagram of a device that includes a pitch detector operable to receive piano string vibrations and produce a detected representative signal.

Referring now to FIG. 5, the detected, or tuning, signal 11 after being amplified by the amplifier 7 can be viewed on a conventional oscilloscope, not shown. If the magnetic pickup 4 is placed near the middle of a piano string 2, a sine wave is observed with a frequency equal to the fundamental frequency of the vibrating piano string 2. Musical tones are a complex mixture of pure sine waves according to Fourier's Law with the lowest frequency and strongest wave being the fundamental frequency, which is what is heard as the musical note. All other waves in the complex mixture of sine waves are known as partials or harmonics. As the magnetic pickup 4 is moved toward the end of the piano string 2, some harmonics are added which make the sine wave appear more complex. These overtones can be removed with a signal conditioning mechanism. A nonlimiting and illustrative type of signal conditioning mechanism is a zero crossing detection circuit 27. When this signal 11 is passed through a zero crossing detection circuit 27, which is another type of signal conditioning mechanism, it will become an audio square wave 29 with a frequency equal to the fundamental frequency of the vibration for the piano string 2.

Audio frequencies are relatively low and their waves are hard to count accurately without encountering the error associated with fractional and incomplete waves. Frequency counting is, therefore, not a viable solution for the measurement of frequency. A much more accurate method is to measure the period of the wave or the time that lapses during one complete cycle. Ultra-high frequency oscillators are very common, small and quite inexpensive today. These oscillators work based on the oscillation of a tiny piezoelectric crystal that produces square waves with frequencies of many millions of cycles per second with extremely high accuracy. Clearly, if you can count the number of oscillator waves generated during a single audio wave, you can obtain a very precise value for the period and thus the pitch of the note. Thus, the tuning signal is processed to determine a first value for a tuning period of the tuning signal.

To effect this desired result, a common INTEL® 82C54 programmable interval timer chip composed of three independent 16-bit counters that handle frequencies up to 10 MHz can be used. This is merely a nonlimiting, illustrative example of the type of timing device that may be utilized with the present invention, however, a wide variety of timing mechanisms will suffice. INTEL® is a registered trademark of the Intel Corporation, which has a place of business at 2200 Mission College Blvd., Santa Clara. Calif. 95052.

Figure 6:
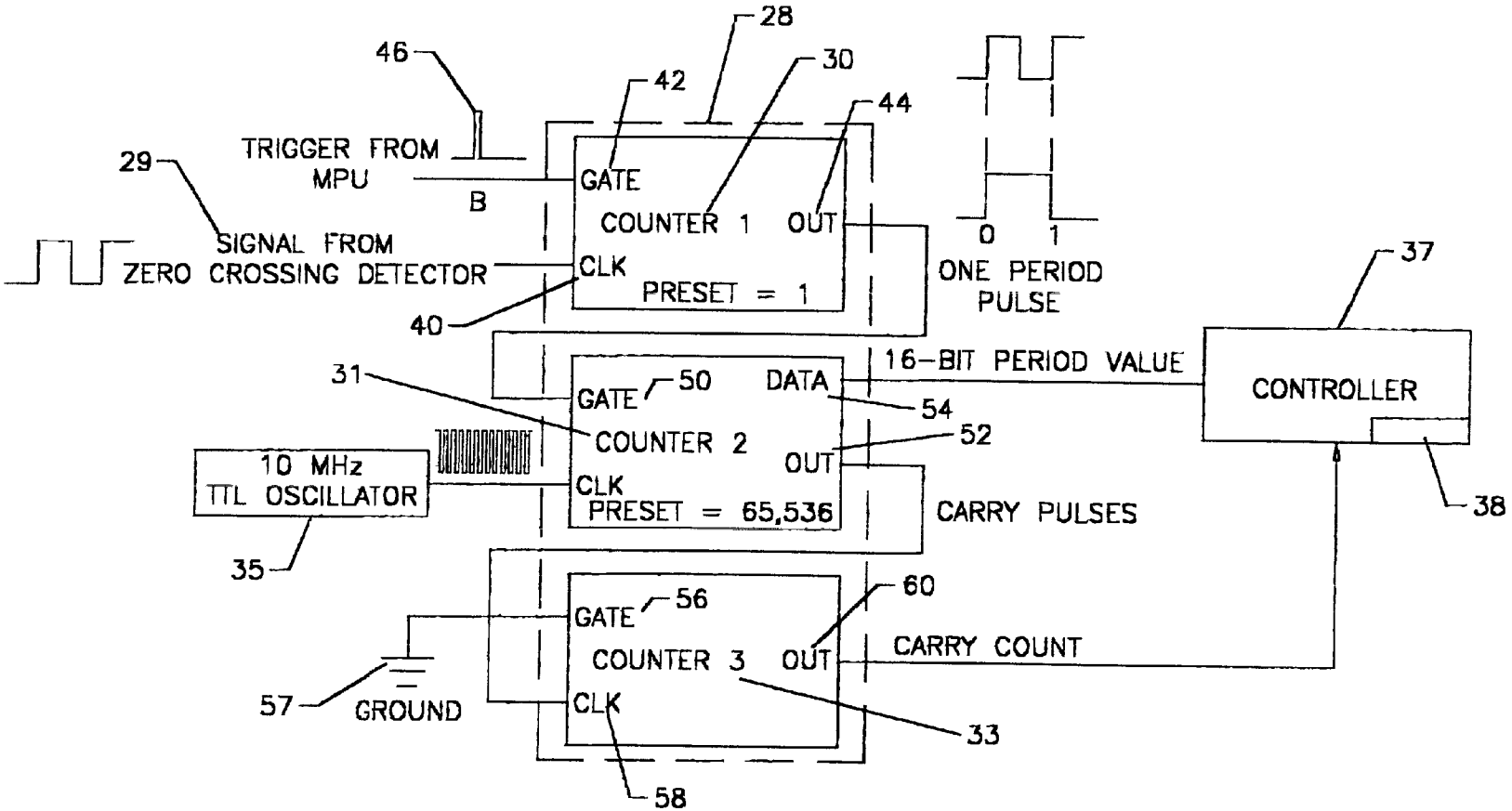
FIG. 6 is an electrical block diagram of a programmable timer chip utilized in conjunction with the pitch detector shown in FIG. 5.

Referring now to FIG. 6, a timer chip is generally indicated by numeral 28. The timer chip 28 includes a first counter 30, having a first clock input 40 that receives the audio square wave 29 from the zero crossing detector circuit 27, as is also shown in FIG. 5. The first counter 30 also includes a first gate input 42 for receiving a signal B. Signal B is used as a trigger since the first counter 30 is programmed to operate in "one-shot" mode. The first output 44 is simply a signal to indicate that the first counter 30 has reached a preset value programmed into it. The first thing to do is to use the audio square wave 29 from the zero crossing detector circuit 27 as the clock signal in the clock input 40 of the first counter 30. This first counter 30 is set-up in a "one-shot" mode. In a "one-shot" mode, the first counter 30 waits for a trigger pulse 46 that is applied to the first gate input 42 and then counts clock inputs until the count reaches a preset value. The first output 44 is activated on the first rising edge of the audio square wave 29 that goes into the first clock input 40 that occurs after a trigger pulse 46 is received by the first gate input 42. The first output 44 is then deactivated on the first rising edge of the audio square wave 29 going into the first clock input 40 after a predetermined number of "ticks" is reached. If the predetermined value of the first counter 30 is set to "1", an output pulse from the first output 44 with a duration equal to exactly one fundamental wave period is obtained.

The second counter 31 is programmed to operate in simple "count-up" mode. The first output 44 from the first counter 30 is sent to the second gate input 50 of the second counter 31. An oscillator 35, e.g. 10 MHz, is connected to the second clock input 48, counting the clock pulses during the one-period pulse. The second counter 31 counts the number of high-frequency pulses that occur during one period of vibration of the piano string 2. This counted value of high frequency pulses can be found on a data output 54 of the second counter 31. This data output 54 can be connected to a controller 37, preferably a microcontroller, and the exact period is now known. For the purposes of this present invention, a wide range of computers and processors can operate as the controller 37.

As an example as to how this counting of high frequency pulses would operate, for the musical note A440 (440 Hz), a correct equal temperament value for its period in terms of a 10 MHz clock would be 10,000,000 divided by 440 or 22,727 ticks. This value for a baseline period can be permanently stored in a memory 38 for the controller 37 and used to compare and evaluate the measured signal. Thus, the first value for the tuning period of the tuning signal is compared to a second value for a baseline period of a musical note to evaluate the tuning signal.

Modem musical instruments are tuned to a standard known as equal temperament. The correct frequencies for all the notes of a piano 1 can be determined by the equation:

$$f_N = 27.5 \times 2^{\frac{N}{12}} \tag{1}$$

where N=number of a note on the piano 1 with the lowest A being 0 and $f_N$=correct frequency for note N.

The period of a wave is simply the reciprocal of its frequency, or $$T_N = \frac{1}{F_N} \tag{2}$$

where $T_N$=correct period for note N. Therefore, the correct period, in clock ticks, for each note can be calculated by the following equation:

$$T_N = \frac{f_c}{F_N} = \left|\frac{1 \times 10^7}{27.5 \times 2^{\frac{N}{12}}}\right| = \left|363{,}636 \times 2^{\frac{-N}{12}}\right| \tag{3}$$

where $f_c$=clock frequency or 10 MHz.

Correct periods are thus calculated for all 88 notes on the piano 1 and stored in memory 38, e.g., EEPROM, for comparison. Unfortunately for the lowest notes on a piano 1, the periods can become quite large (363,636 ticks for $A_0$) and exceed the 16 bit-maximum capacity for the second counter 31 ($12^{16}$=65,536). To remedy this we set up the second counter 31 to output a pulse whenever its 16 bit-accumulator is full and connect this second output 52 to a third clock input 58 for a third counter 33 and count these overflows as a sort of "carry" bit to determine the total number. This "carry" bit is obtained from the third output 60, which is connected to the controller 37. For this third counter 33, the third gate input 56 is connected to ground 57. If period values are thought of in hexadecimal notation, the carry count is simply another digit. From the period value, the controller 37 determines what note is being played by calculating which of the stored equal temperament periods that is closest to the sampled note. Then it calculates how far the note is out-of-tune, which is otherwise known as error or a differential value.

The sound of a piano string 2 is a composite of individual sine waves or partials and consists of a fundamental and many harmonics. The fundamental is what is perceived as the musical pitch. It is the fundamental that must be focused on when tuning a piano 1 since when the fundamental is in tune all harmonics will follow. Fortunately, for the piano 1, the fundamental is the lowest partial of all, which renders it easy to extract from the whole signal.

Figure 7:
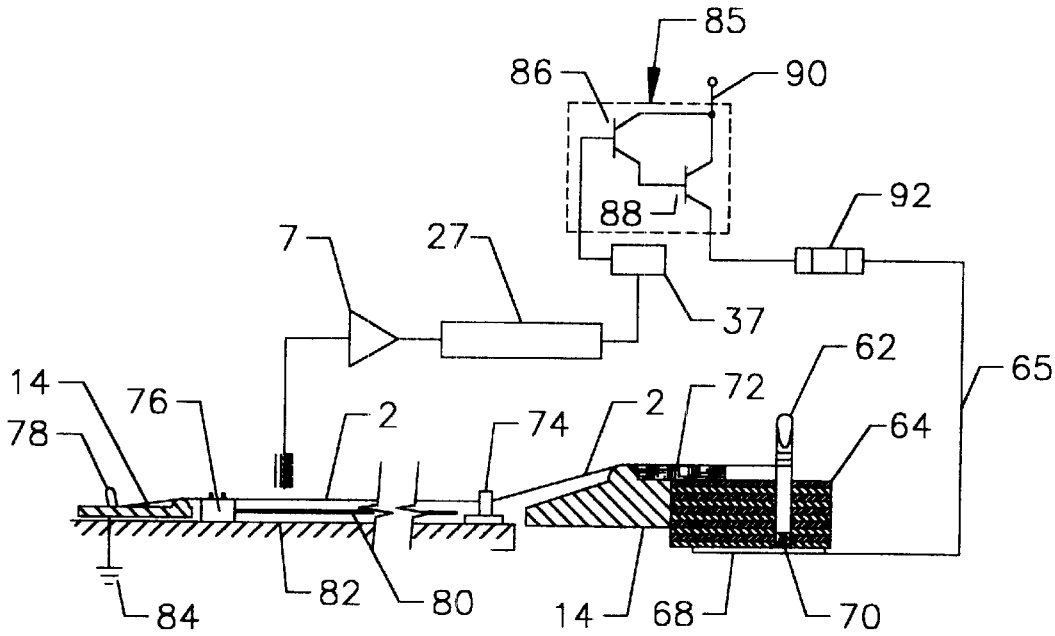
FIG. 7 is an electrical schematic block diagram and side view of the device of the present invention for controlling pitch of a piano string to a desired tuned value through a selective application of voltage.

Referring now to FIG. 7, the adjustment of the pitch of each note is effected by first constructing the piano 1 with piano strings 2 that are electrically insulated from each other. Each piano string 2 is connected at one end to a first attachment mechanism, e.g., tuning pin 62. The piano string 2 extends from the tuning pin 62 over a string rest 72. A traditional string rest is a hard metal bearing surface with a thick felt strip located on the upper surface. In this case, the string rest 72 will need to be formed of insulating material, e.g., plastic, ceramic and so forth or a layer of insulating material must be positioned between the upper surface of the string rest 72 and the piano strings 2 so that the piano strings are electrically insulated from each other.

The piano string 2 then extends through an agraffe 74 and then over a reflective shield 80 that is located between the piano string 2 and a soundboard 82 of the piano 1. The reflective shield 80 is used to prevent the desiccating effects of radiant heat on the soundboard 82. For an upright piano (not shown), a ventilation grid would be provided on the top lid to allow warm air to escape and not build up inside the piano 1. The piano string 2 then extends over a supporting bridge 76 and finally connects to a second attachment mechanism, e.g., hitch pin 78, at the opposite end of the piano string 2. The supporting bridge 76 is directly attached to the soundboard 82 and the hitch pin 78 is directly mounted into the harp 14.

The pin block 64, agraffe 74, supporting bridge 76 and string rest 72 are also made of insulating material or at the very least utilize insulating material surrounding the piano string 2 and function as insulating mechanisms to electrically insulate the piano wires 2 from each other. None of these modifications should adversely affect the sound quality of the piano 1.

The mechanism for altering the pitch of the piano strings 2 is the application of voltage and the associated flow of current through the preferably metal piano string 2, which would heat the piano string 2 and elongate the piano string 2 due to thermal expansion. Electrode wire 65 is electrically connected to the piano string 2. This is preferably, but not necessarily, accomplished by connecting the electrode wire 65 to the tuning pin 62 by a insulating circuit board 64 with a spring 70, e.g., like those utilized in a AA battery compartment, with conductive traces, e.g., etched copper, that extend to an edge of the insulating circuit board 64 for connection to the electrode wire 65. The springs 70 would be in the pattern of the tuning pins 62 for the piano 1. This provides a simple manner to provide access for a technician to work on the action of the piano 1 with only the thickness of the insulating circuit board 64 creating any possible interference with this procedure. The insulating circuit board 64 is formed of dielectric material and is located adjacent to the harp 14.

The other end of the piano wire 2 is connected to ground 84, which preferably involves an electrical connection to the harp 14 of the piano 1. If a positive electrical voltage is applied to the electrode wire 65, which provides electrical voltage through the traces in the insulating circuit board 64 to the spring 70, which is in contact with the tuning pin 62, then a current is produced in the piano string 2 that causes the piano string 2 to increase in temperature due to the electrical resistance. This current is carefully maintained via the control circuit, as previously described above and shown in FIGS. 5, 6 and 7, based on the out-of-tune error or differential value. When a piano string 2 is heated, elongation takes place due to thermal expansion. This causes the tension in the piano string 2 to decrease and the frequency of the string becomes lower. Conversely, when the piano string 2 is allowed to cool and thermally contract, a higher pitch and associated frequency is produced. In this manner, the pitch of the piano string 2 can be controlled electronically. The preferred piano string 2 is made of metal so that the resistivity is low and thus the voltage required to produce the appropriate temperature in the piano string 2 is also very low.

The preferred voltage signal is a pulse width modulated signal, however, this is not absolutely necessary. This voltage signal is generated from the controller 37, however, a separate controller or processor may be utilized. A switching circuit or mechanism, generally indicated by numeral 85, selectively applies voltage from a voltage source 90 to the electrode wire 65, which is connected to the spring loaded contract probe 70. One type of switching circuit 85 would include a pair of transistors, 86 and 88, which are preferably Darlington power transistors. The reason for the switching circuit 85 is that a controller 37 is unable to supply the power required to heat the piano strings 2. With a pulse width modulated (PWM) signal, the load is switched on and off for a certain percentage of time, which is otherwise known as a duty cycle. The higher the percentage of "on time" in the duty cycle, the higher the average current is through the piano string 2. Each electrode wire 65 includes a fuse 92 to ensure that no piano string 2 becomes excessively hot.

Figure 8:
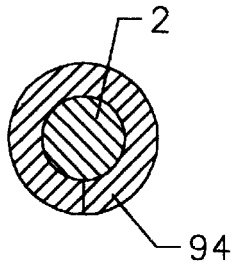
FIG. 8 is an cross-sectional view of a bass piano string encircled with magnet wire associated with the present invention.

The lowest bass piano strings 2 in a piano 1 are traditionally wrapped with one or two layers of copper wire to increase mass of the piano string 2 and lower the tone without the necessity of excessively long piano strings 2. These windings would effectively short-circuit the wrapped portion of the piano string 2 due to the much lower resistivity of the copper and thus would require larger currents to change the pitch. Because of this, as shown in FIG. 8, the bass piano strings 2 are wound with magnet wire 94. This is the type of wire that is used to wind solenoids, transformers, motor windings, and so forth. This magnet wire 94 is coated with a thin coat of lacquer so that it will not conduct electricity when it is in contact with the piano string 2. The piano strings 2 will now behave electrically in the same manner as it would without the magnet wire 94.

Figure 9:
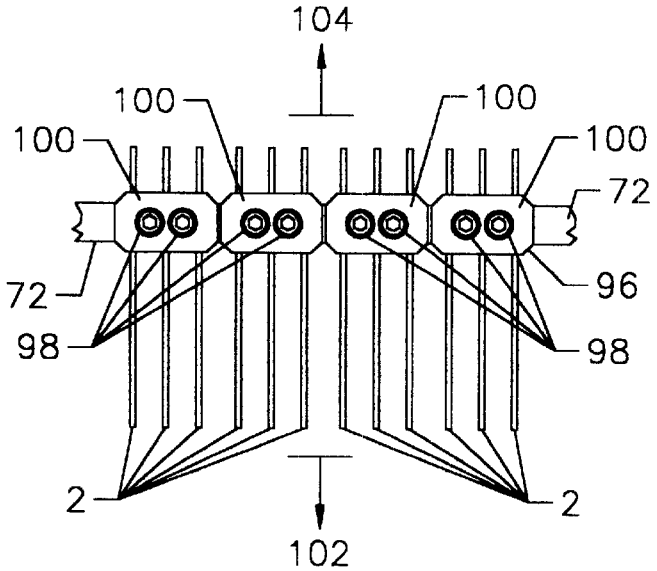
FIG. 9 is an isolated top view of the piano string lock and string rest associated the device of the present invention for securing piano strings after an initial tuning.

When a piano 1 is initially tuned at the factory, the self-tuning apparatus of the present invention is activated to uniformly heat all of the piano strings 2 to an arbitrary median temperature. Referring now to FIG. 9, the piano 1 is manually tuned to the correct pitches and then piano string locks 100 secure the piano strings 2 in place. These piano string locks 100 include a plate 96 that is preferably, but not necessarily, formed of metal that is located over the string rest 72, as shown in FIG. 6, which is formed of insulating material, e.g., plastic, ceramic and so forth or a layer of insulating material must be positioned between the upper surface of the string rest 72 and the piano strings 2 so that they are electrically insulated from each other. The plate 96 is preferably, but not necessarily, secured with screws 98. There is an upper arrow 104 indicating that the piano strings 2 travel upward from the string locks 100 to the tuning pins 62, which have now been rendered superfluous. There is a lower arrow 102 indicating that the piano strings 2 travel downward to the agraffles 74. The electronic circuit of the present invention can now control the tuning of the piano 1.

Referring again to FIG. 1, directly in front of the keys 104 of the piano is a keyslip 105. The self-tuning piano 1 of the present invention utilizes a "tune" switch 106, which is preferably, but not necessarily an on-off pushbutton switch. When the operator depresses the damper pedal (not shown) of the piano 1 and then the tune switch 106 is depressed, the control circuit of FIG. 7 is activated and is in a "tuning mode." All of the piano strings 2 will be sustained and tuned at once through the drive coils 10 or combination magnetic pickup and drive coils 12. The operator will know when the piano is in tune when the piano strings 2 stop sustaining and go silent and all eighty-eight notes have been tuned. The sustain-driving circuits shown in FIGS. 3 and 4 are capable of sustaining the piano strings 2 simultaneously, without requiring the piano strings to be hit by the hammers 3. The "tune" switch 106 is again depressed and the piano 1 will function as normal. The pulse width modulated (pwm) duty cycle will be stored in non-volatile memory 38 of the controller 37 until the next tuning of the piano 1 is required.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. An apparatus for self-tuning a piano comprising:

a housing;

a plurality of piano strings, each having a first end portion and a second end portion;

a plurality of first attachment mechanisms for respectively securing the first end portion of each piano string of the plurality of piano strings to the housing;

a plurality of second attachment mechanisms for respectively securing the second end portion of each piano string of the plurality of piano strings to the housing; and a voltage mechanism electrically connected to each piano string of the plurality of piano strings for selectively applying voltage to thermally expand each piano string of the plurality of piano strings to alter pitch to a predetermined value.

2. The apparatus according to claim 1, wherein each piano string of the plurality of piano strings is electrically insulated by at least one insulating mechanism.

3. The apparatus according to claim 2, wherein the at least one insulating mechanism includes an agraffe.

4. The apparatus according to claim 2, wherein the at least one insulating mechanism includes a bridge.

5. The apparatus according to claim 2, wherein the at least one insulating mechanism includes a string rest having an insulating upper surface.

6. The apparatus according to claim 1, wherein each first attachment mechanism of the plurality of first attachment mechanisms includes a tuning pin.

7. The apparatus according to claim 1, wherein each second attachment mechanism of the plurality of second attachment mechanisms includes a hitch pin.

8. The apparatus according to claim 6, further includes at least one block of insulating material surrounding the tuning pin.

9. The apparatus according to claim 6, wherein the voltage mechanism includes a contact that is electrically connected to the tuning pin.

10. The apparatus according to claim 9, wherein the contact that is electrically connected to the tuning pin includes a spring.

11. The apparatus according to claim 1, wherein the voltage mechanism includes a voltage source electrically connected to a switching mechanism, wherein the switching mechanism is responsive to a difference between a pitch of each piano string of the plurality of piano strings and a predetermined value of pitch for each piano string of the plurality of piano strings.

12. An apparatus for self-tuning a piano comprising:

a housing;

a plurality of piano strings, each having a first end portion and a second end portion;

a plurality of first attachment mechanisms for securing the first end portion of each piano string of the plurality of piano strings to the housing;

a plurality of second attachment mechanisms for securing the second end portion of each piano string of the plurality of piano strings to the housing;

a voltage mechanism that is electrically connected to each piano string of the plurality of piano strings;

a plurality of pickups positioned adjacent to the plurality of piano strings that generates a signal that is representative of pitch for each piano string of the plurality of piano strings; and a pitch comparison mechanism that contrasts the representative value for pitch for each piano string of the plurality of piano strings with a predetermined value of pitch for each piano string of the plurality of piano strings and generates a differential value, wherein the pitch comparison mechanism is electrically connected to the voltage mechanism so that voltage from the voltage mechanism can be applied to each piano string of the plurality of piano strings so that the respective differential value can be minimized due to thermal expansion of each piano string caused by an application of voltage.

13. The apparatus according to claim 12, wherein each pickup of the plurality of pickups includes a magnetic pickup.

14. The apparatus according to claim 12, further includes a plurality of drive coils for sustaining vibration in the plurality of piano strings.

15. The apparatus according to claim 12, wherein each pickup of the plurality of pickups is a combination magnetic pickup and drive coil.

16. The apparatus according to claim 12, wherein the voltage mechanism includes a voltage source that is selectively turned on and off by a switching mechanism, which is electrically connected to the pitch comparison mechanism.

17. The apparatus according to claim 16, wherein the switching mechanism includes at least one power transistor.

18. The apparatus according to claim 12, further includes an amplifier that amplifies the signal that is representative of pitch coming from each pickup of the plurality of pickups.

19. The apparatus according to claim 12, further includes a filter that removes extraneous noise from the signal that is representative of pitch coming from each pickup of the plurality of pickups.

20. The apparatus according to claim 12, further includes a zero crossing detector that alters the signal that is representative of pitch coming from each pickup of the plurality of pickups into a square wave.

21. The apparatus according to claim 12, wherein the pitch comparison mechanism includes at least one counter.

22. The apparatus according to claim 12, wherein the pitch comparison mechanism includes at least one controller, having a memory for storing predetermined values of pitch associated with each piano string of the plurality of piano strings, wherein the at least one controller can contrast a representative pitch signal for each piano string of the plurality of piano strings against a respective predetermined pitch value stored in the memory of the at least one controller.

23. A apparatus for self-tuning a piano comprising:

a housing;

a plurality of piano strings, each having a first end portion and a second end portion;

a plurality of tuning pins for securing the first end portion of each piano string of the plurality of piano strings to the housing;

a plurality of hitch pins for securing the second end portion of each piano string of the plurality of piano strings to the housing;

a voltage source connected to a selective switching mechanism, which is electrically connected to each piano string of the plurality of piano strings;

a plurality of magnetic pickups positioned adjacent to the plurality piano strings that generates a signal that is representative of pitch for each piano string of the plurality of piano strings;

a plurality of drive coils positioned adjacent to the plurality piano strings that sustains vibration in each piano string of the plurality of piano strings; and a controller that contrasts the representative value for pitch for each piano string of the plurality of piano strings with a predetermined value of pitch for each piano string of the plurality of piano strings and generates a differential value, wherein the controller is electrically connected to the switching mechanism so that pulse width modulated voltage from the voltage source can be applied to each piano string of the plurality of piano strings so that the respective differential value can be minimized due to thermal expansion of each piano string by an application of voltage and thermal contraction in an absence of voltage.

24. A method for self-tuning a piano comprising:

selectively applying voltage with a voltage mechanism to each piano string of a plurality of piano strings to provide thermal expansion of each piano string by an application of voltage and thermal contraction of each piano string in an absence of voltage to alter pitch of the piano string to a predetermined value, wherein each piano string of the plurality of piano strings has a first end portion and a second end portion, wherein the first end portion of each piano string of the plurality of piano strings is respectively secured to a housing by a plurality of first attachment mechanisms and the second end portion of each piano string of the plurality of piano strings is respectively secured to the housing by a plurality of second attachment mechanisms and the plurality of piano strings are electrically insulated from each other.

25. A method for self-tuning a piano comprising:

selectively applying voltage with a voltage mechanism to each piano string of a plurality of piano strings to provide thermal expansion of each piano string by an application of voltage and thermal contraction of each piano string in an absence of voltage to alter pitch of the piano string to a predetermined value, wherein each piano string of the plurality of piano strings has a first end portion and a second end portion, wherein the first end portion of each piano string of the plurality of piano strings is respectively secured to a housing by a plurality of first attachment mechanisms and the second end portion of each piano string of the plurality of piano strings is respectively secured to a housing by a plurality of second attachment mechanisms and the plurality of piano strings are electrically insulated from each other;

generating a signal that is representative of pitch for each piano string of the plurality of piano strings with a plurality of pickups positioned adjacent to the plurality of piano strings;

comparing the representative value for pitch for each piano string of the plurality of piano strings with a predetermined value of pitch for each piano string of the plurality of piano strings with a pitch comparison mechanism to generate a differential value; and selectively applying voltage from the voltage mechanism to each piano string of the plurality of piano strings so that the respective differential value can be minimized due to thermal expansion of each piano string by an application of voltage and thermal contraction of each piano string in an absence of voltage.

26. The method according to claim 25, wherein the step of generating a signal that is representative of pitch for each piano string of the plurality of piano strings further includes utilizing at least one counter to generate a square wave representation of the pitch for each piano string of the plurality of piano strings.

27. The method according to claim 25, wherein the step of generating a signal that is representative of pitch for each piano string of the plurality of piano strings further includes maintaining vibration in the plurality of piano strings by utilizing a plurality of drive coils.

28. The method according to claim 25, wherein the step of comparing the representative value for pitch for each piano string of the plurality of piano strings with a predetermined value of pitch for each piano string of the plurality of piano strings with a pitch comparison mechanism to generate a differential value further includes utilizing a controller having a memory of stored values of pitch.

29. The method according to claim 25, wherein the step of selectively applying voltage from the voltage mechanism to each piano string of the plurality of piano strings so that the respective differential value can be minimized due to thermal expansion of each piano string associated with the application of voltage, further includes utilizing a voltage mechanism that includes a voltage source that is selectively pulse width modulated with at least one power transistor.

* * * * *

UNITED STATES PATENT AND TRADEMARK OFFICE

CERTIFICATE OF CORRECTION

PATENT NO. : 6,559,369 B1
DATED : May 6, 2003
INVENTOR(S) : Donald A. Gilmore

It is certified that error appears in the above-identified patent and that said Letters Patent is hereby corrected as shown below:

Column 1,
Line 24, after the word "*motor*", delete "art";

Column 6,
Line 1, delete "Modem" and replace with -- Modern --;

Signed and Sealed this

Nineteenth Day of August, 2003

JAMES E. ROGAN
*Director of the United States Patent and Trademark Office*